United States Patent [19]

Sitwell et al.

[11] Patent Number: 4,664,254

[45] Date of Patent: May 12, 1987

[54] SHIPPING CONTAINER FOR WORKS OF ART

[76] Inventors: Christine L. Sitwell, Saracens House, Corton Near Warminser, Wiltshire BA12 05Z; Keith Wrightson, 90 Lyndhurst Grove, London SE15; Richard C. Sparks, 15 Rannoch Rd., Hammersmith, London W6, all of England

[21] Appl. No.: 740,868

[22] Filed: Jun. 3, 1985

[30] Foreign Application Priority Data

Jun. 6, 1984 [GB] United Kingdom ..... 8414484

[51] Int. Cl.[4] ..... B65D 85/48

[52] U.S. Cl. ..... 206/1.7; 206/453; 206/454; 206/583; 206/526; 248/505; 220/4 E

[58] Field of Search ..... 206/1.7, 1.8, 1.9, 292, 206/293, 454, 455, 521, 456, 525, 526, 449, 505, 586, 583, 514; 248/505; 211/45–47; 108/55.5; 220/4 B, 4 E

[56] References Cited

U.S. PATENT DOCUMENTS

| | | | |
|---|---|---|---|
| 2,110,947 | 3/1938 | Bartels | 248/505 |
| 2,895,599 | 7/1959 | Moyer et al. . | |
| 2,939,603 | 6/1960 | Young | 220/4 B |
| 2,950,001 | 8/1960 | Bucko | 206/586 |
| 2,976,985 | 3/1961 | Kraus | 206/449 |
| 3,640,420 | 2/1972 | Carter et al. | 220/415 |
| 3,653,707 | 4/1972 | Pile et al. | 206/583 |
| 3,655,034 | 4/1972 | Stollman et al. . | |
| 3,927,764 | 12/1975 | Fox | 206/454 |
| 4,013,170 | 3/1977 | Hutterer | 206/525 |
| 4,081,119 | 3/1978 | Messmore . | |
| 4,156,498 | 5/1979 | Miller . | |
| 4,446,968 | 5/1984 | Bremer | 206/1.7 |
| 4,476,988 | 10/1984 | Tanner | 220/1.5 |

FOREIGN PATENT DOCUMENTS

| | | | |
|---|---|---|---|
| 689934 | 7/1964 | Canada | 206/514 |
| 2326295 | 11/1973 | Fed. Rep. of Germany | 206/583 |
| 1519008 | 2/1968 | France | 248/505 |
| 406357 | 2/1934 | United Kingdom | 206/293 |
| 2106249 | 4/1983 | United Kingdom | 206/521 |

OTHER PUBLICATIONS

Packing: A Case Study, by Sarah Staniforth, p. 53–62.
Fabwell Sales Brochure.
Hardigg Sales Brochures.

*Primary Examiner*—William Price
*Assistant Examiner*—Brenda J. Ehrhardt

[57] ABSTRACT

The invention comprises a shipping container with a flexibly mounted adjustable, removable suspension system for transporting works of art of various dimensions. The container includes two identical composite wall sections, each section having a flanged mating surface to form a seal when the container is closed. Each of the wall sections is a composite structure having an inner and an outer skin with an insulation layer in between. Each composite wall section is flexibly mounted to an outer flange to further cushion the assembled shipping container for mechanical shocks. Longitudinal and latitudinal stiffeners are attached on each end to the second flange and span the outer surface of the container. The adjustable, removable suspension system within the container includes a support frame resiliently mounted in each composite wall section. A support strap system in combination with abutment angles support the framed work of art and fix its position relative to the frame. An adjustable locking mechanism is secured to the support strap system when locking clasp is perpendicular to support strap system. Securing straps pass over the frame and extend to adjustable locking mechanisms thereby completely securing the work of art to the frame. The locking mechanisms are cushioned to avoid damaging the work of art.

32 Claims, 10 Drawing Figures

SHIPPING CONTAINER FOR WORKS OF ART

BACKGROUND OF THE INVENTION

1. Field of the Invention

The field of the invention relates to reusable containers to transport framed works of art including but not limited to paintings, prints, photographs, and drawings.

2. Description of the Prior Art

In the past, works of art were shipped primarily in wooden crates specifically designed for a particular work or works. Single or multiple cases were used depending upon the size and type of work and frame. The wooden crate was lined with a cushioning and/or insulating material made of various substances depending upon the type of work and preference of the packer. This method of crating had several disadvantages including high material and construction costs; limited durability and useful life; lack of standardization in weight and size of crate; and inconsistent environmental, shock, and vibration protection.

Reusable containers of fiberglass and wood had been developed but still required the preparation and fitting of any internal cushioning by the user. Containers used to ship other products such as highly sensitive equipment had also been adapted to transport three dimensional works of art.

Prior art containers included a rectangular housing having a plurality of guide grooves which were used to secure the frames of the artwork. The container disclosed in U.S. Pat. No. 4,081,119 was typical of such designs. Some designs allowed adjustments in the width of the grooves to accommodate frames of varying thickness as illustrated in U.S. Pat. No. 4,156,498. Other devices for crating paintings such as those shown in U.S. Pat. No. 2,895,599 featured a layered approach with a rigidly mounted support platform which supported the picture frames. In this design, a tightening strap was connected at various points to the mounting platform via selected holes in the mounting platform thereby allowing the crate to accommodate frames of different sizes. The container disclosed in U.S. Pat. No. 3,655,034 employed resilient mounting plates to support urethane foam shock mounts which secured the corners of a picture frame. The shock mounts could be positioned at different points in the mounting plate to accommodate various frame sizes.

SUMMARY OF THE INVENTION

Briefly stated, the present invention comprises a shipping container having a unique, flexibly mounted, adjustable, removable suspension system for transporting framed works of art of various dimensions. The container includes two identical composite wall sections, each section having a flanged mating surface to form a seal when the container is closed in the manner set forth in detail below. Each of the wall sections is a composite structure having an inner and an outer skin with an insulation layer in between. Each composite wall section is flexibly mounted to an outer flange to further cushion the assembled shipping container from mechanical shocks. Longitudinal and latitudinal stiffeners are attached each on end to the outer flange and span the outer surface of the container to provide further protection.

The adjustable, removable suspension system includes a support frame resiliently mounted in each composite wall section. A support strap system in combination with abutment angles support the work of art and fix its position relative to the frame. Securing straps pass over the frame and extend to adjustable locking mechanisms thereby completely securing the work of art to the frame. The locking mechanisms are cushioned to avoid damaging the frame of the work of art.

A pallet segment is connected to the outer flange of each composite wall section. The pallet segments are each resiliently mounted to each outer flange to further cushion the assembled container from mechanical shocks. Upon assembling one composite wall section to another, the pallet segments on each wall section interlock with each other thereby forming a unified pallet structure for support of the shipping container. The pallet sections contain shaped metal feet which raise the pallet sections off the ground thereby allowing easy handling of the assembled container by a forklift truck or mobile dolly.

DESCRIPTION OF THE PREFERRED EMBODIMENT

Figure 1:
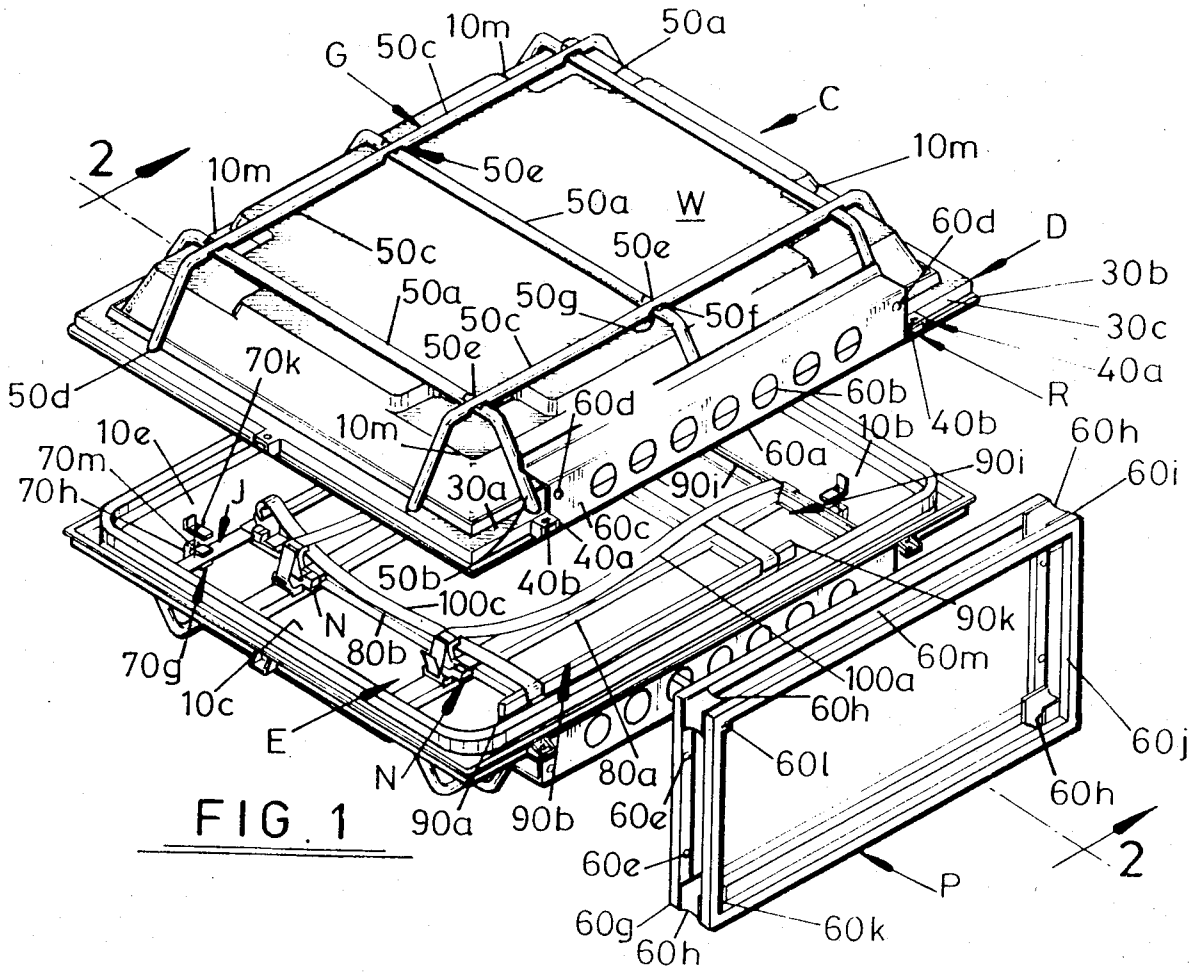
FIG. 1 is an exploded perspective view of the shipping container and one embodiment of pallet.
Figure 2:
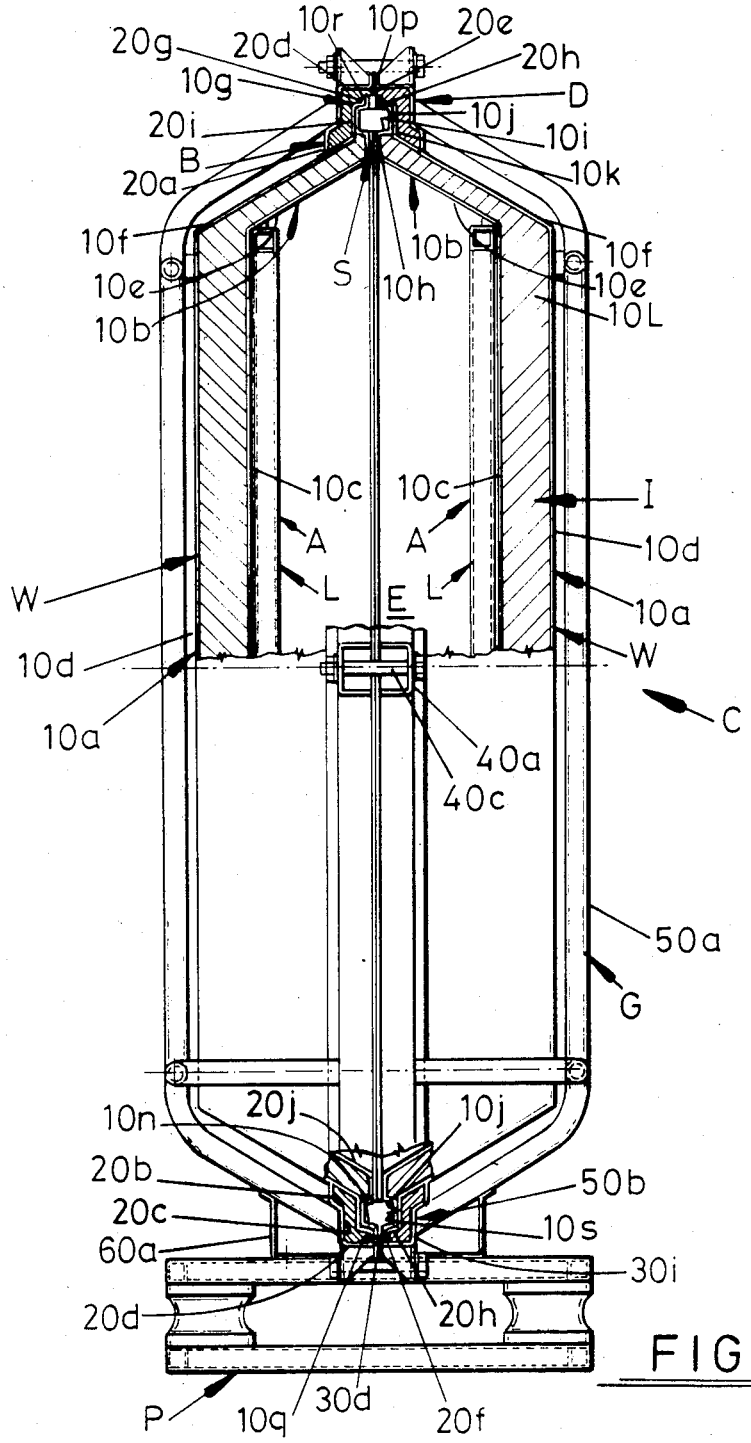
FIG. 2 is a partial sectional view taken along lines 2—2 of FIG. 1 and part end view.

Referring now to the drawings, a container according to the present invention is illustrated and designated generally by the letter C. As seen in FIGS. 1 and 2, container C includes identical composite wall sections W having seal S interposed therebetween. The assembled container C may be mounted on a pallet P for ease of movement and vibration isolation during the shipment process. An adjustable, removable suspension system A is mounted in each composite wall section W to suspend a framed work of art F (FIG. 6) therein. Although not specifically illustrated, container C may also include intermediate sections mounted between wall sections W to provide a container C having larger interior dimensions.

Referring now to FIGS. 1 and 2, unitary wall section W is preferably vacuum formed of plastic material such as acrylonitrile butadiene styrene, for example, and has a flat segment 10*a* and a plurality of side segments 10*b*. The flat segment 10*a* has an inner skin 10*c* and an outer skin 10*d*. Inner skin 10*c* is connected around its entire periphery to inner skin 10*e* of side segments 10*b*. Similarly, outer skin 10*d* is connected around its periphery to outer skin 10*f* of side segments 10*b*. The angle formed between inner skin 10*e* and inner skin 10*c* is obtuse. Accordingly, composite wall section W defines an enclosure E (FIG. 1) bounded by flat segment 10*a* on the bottom and outwardly sloping side segments 10*b* connected to flat segment 10*a* and gradually sloping upwardly and away from flat segment 10*a*.

As best seen in FIG. 2, side segments 10*b* are formed having a flange 10*g* at their upper end opposite the end where side segments 10*b* join flat segment 10*a*. Flange 10*g* is formed in part by segment 10*h* which extends from inner skin 10*e* of side segments 10*b* to segment 10*i*. Segment 10*i* is substantially perpendicular to segment 10*h* and connects segment 10*h* to segment 10*j*. At the same time, segment 10*k* extends from outer skin 10*f* of side segments 10*b* and abuts segment 10*j* thereby defining an enclosed cavity 10L. Cavity 10L is defined by inner skin 10*c*, inner skin 10*e*, segment 10*h*, segment 10*i*, segment 10*k*, outer skin 10*f*, and outer skin 10*d*.

Insulator I is housed within cavity 10L. Insulator I is preferably a rigid polyurethane foam having a density of thirty kilograms per cubic meter. As best seen in FIG. 2 the thickness of insulator I is not uniform. The portion of insulator I lying between outer skin 10*d* and inner skin 10*c* of flat segment 10*a* is thicker than that between inner skin 10*e* and outer skin 10*f* of side segments 10*b*. For typical applications, insulator I has a maximum layer thickness of approximately sixty millimeters between inner skin 10*c* and outer skin 10*d* and up to thirty-six millimeters between outer skin 10*f* and inner skin 10*e*. Additionally, as seen in FIG. 1, insulator I may be narrow at the portions underlying corners 10*m* of flat segment 10*a* than elsewhere. The portions of maximum thickness of insulator I are those which underly the larger surface areas of wall section W in order to provide environmental protection without reducing the internal dimensions of container C or the ease of stackability. Insulator I also contributes to the structural rigidity of wall section W as well as providing the requisite insulation for container C.

Referring to FIG. 2, flange 10*g* is formed by segments 10*h*, 10*i*, 10*j*, 10*n* and 10*p*. Segment 10*n* is substantially perpendicular to segment 10*j* and segment 10*p* is substantially perpendicular to segment 10*n*. Flange 10*g* is strengthened by an extension of outer skin 10*f* which is formed by segment 10*k*, 10*q* and 10*r*. Segment 10*q* is substantially perpendicular to segment 10*k* and segment 10*r* is substantially perpendicular to segment 10*q*. Segment 10*k* is attached to segment 10*j* segment 10*n* is attached to segment 10*q*, and segment 10*p* is attached to segment 10*r*. Accordingly, segments 10*h*, 10*i*, 10*j*, 10*n*, and 10*p* of the flange 10*g* form a continuous channel 10*s* which substantially encloses seal S between two identical composite wall sections W.

As best seen in FIG. 2, shock absorber B is sandwiched between outer skin 10*f*, segment 10*k*, segment 10*q*, segment 10*p*, segment 10*r* and outer flange D. As seen in FIG. 2, shock absorber B extends completely around each wall section W and acts as a cushion to isolate wall section W from mechanical shocks imparted to outer flange D or stiffener G connected thereto. Shock absorber B is preferably formed of hard rubber although other suitable resilient material may be used without departing from the spirit of the invention. Shock absorber B is attached to outer flange D and to outer skin 10*f*, segments 10*k*, 10*q* and 10*r* by a suitable conventional heavy duty contact adhesive. Shock absorber B is defined by surfaces 20*a* through 20*j* as shown in FIG. 2.

Outer flange D abuts shock absorber B at surfaces 20*b*, 20*c*, and 20*d*. Outer flange D has a bearing surface 30*a* which supports stiffener G. Outer flange D further includes perpendicular mounting surfaces 30*b* and 30*c* (FIG. 1) to which retainer R is secured. Outer flange D has a mating surface 30*d* which, as shown in FIG. 2, abuts a mating surface 30*d* when one wall section W is mounted to an adjacent wall section W.

Retainer R includes a plurality of lugs 40*a* each defining a through hole 40*b* (see FIG. 1). When two wall sections W are aligned, as shown in FIG. 2, a through bolt 40*c* secures corresponding lugs 40*a* on each wall section W thereby allowing flange 10*g* to substantially enclose seal S. Accordingly, lugs 40*a* in combination with through bolts 40*c* maintain container C in a closed, fluid tight condition for transportation.

Seal S is preferably made of a closed cell neoprene rubber although other suitable, similar materials may be used without departing from the spirit of the invention. When container C is assembled, seal S is substantially enclosed in continuous channel 10*s* (see FIG. 2) formed in each wall section W.

Shipping container C also includes stiffener G as shown in FIGS. 1 and 2. Stiffener G includes a plurality of tubular members 50*a* which, as shown in FIG. 2 span over outer skin 10*f* of side segments 10*b* as well as outer skin 10*d* of flat segment 10*a*. Each end 50*b* of tubular stiffening members 50*a* (FIG. 2) is welded to bearing surface 30*a*. Although members 50*a* are shown having circular cross-section other cross-sections can be used without departing from the spirit of the invention. Stiffener G also includes tubular stiffening members 50*c* which span outer skin 10*f* of side segments 10*b* and outer skin 10*d* of flat segment 10*a*. The ends 50*d* of tubular members 50*c* are welded to bearing surface 30*a* of outer flange D. Members 50*a* are disposed substantially perpendicular to members 50*c*. Members 50*a* overlap members 50*c* at several junctures 50*e*, as shown in FIG. 1. A flat 50*f* on members 50*a* is designed to overlap a flat 50*g* on members 50*c*. Flat 50*f* may be secured to flat 50*g* in any suitable, conventional manner such as by is welding flat 50*f* to flat 50*g* at each point 50*e* where tubular member 50*a* overlaps tubular member 50*c*. The net result is a reinforced protective web around wall section W which transmits any mechanical shocks imparted to tubular members 50*a* or 50*c* to outer frame D which is insulated from composite wall section W by shock absorber B. It is important, as shown in FIG. 2 that stiffening members 50*a* and 50*c* span over outer skin 10*f* and 10*d* without making any contact therewith.

Figure 8:
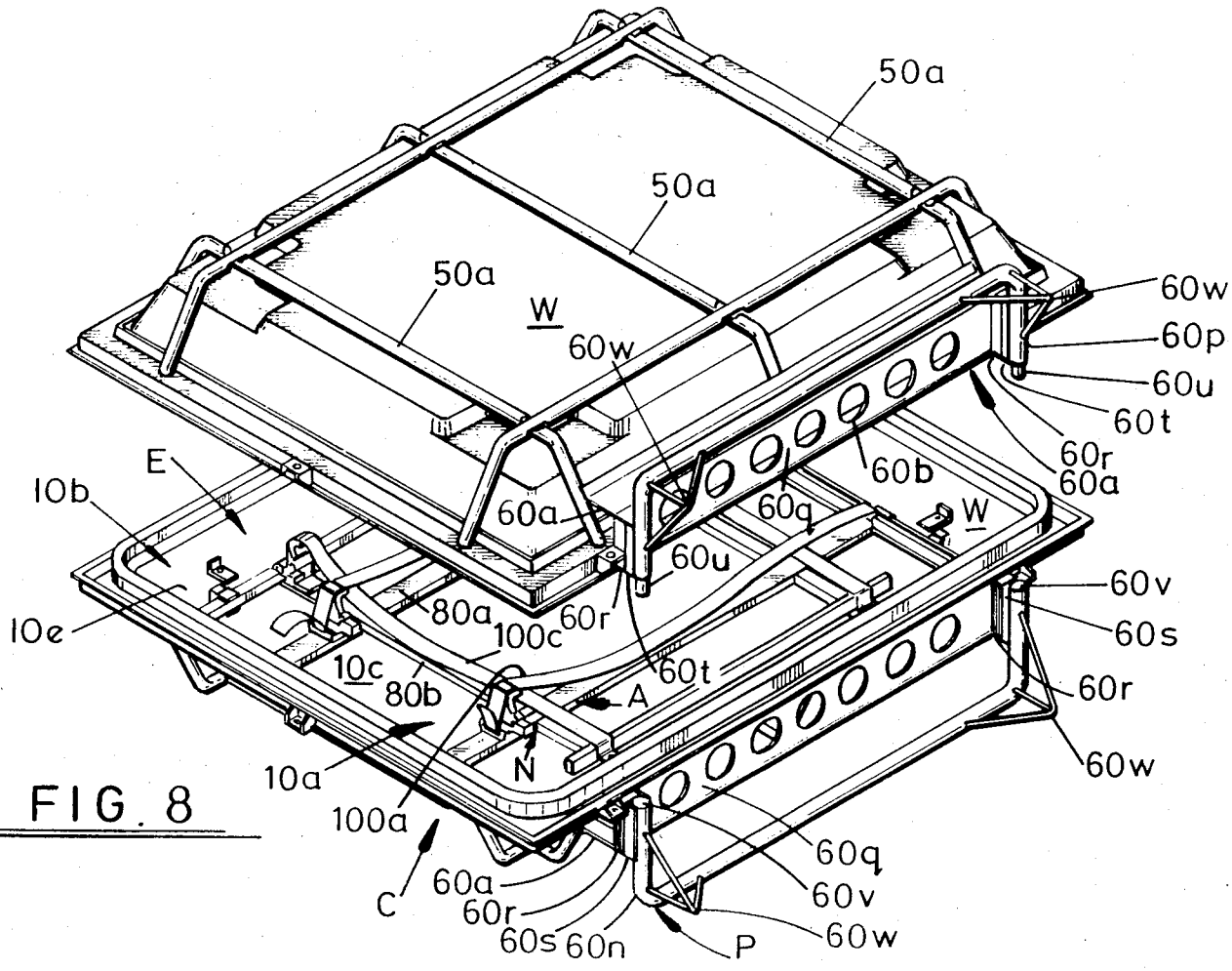
FIG. 8 is an exploded perspective view of the shipping container showing the preferred embodiment of the pallet.

As shown in FIGS. 1 and 8, a pallet mounting angle 60*a* is disposed on one side of wall section W. Pallet mounting angle 60*a* is connected at one end to mounting surface 30*b* and at the other end to tubular members 50*a*. Pallet mounting angle 60*a* is formed having large openings 60*b* to reduce its overall weight without detracting substantially from its strength. As best seen in FIG. 1, pallet mounting angle 60*a* has a mounting surface 60*c* which is in a plane substantially perpendicular to bearing surface 30*a*. Openings 60*d* (FIG. 1) are used to secure pallet P to pallet mounting angle 60*a* via a through bolt (not shown) inserted through openings 60*e* defined by pallet P and openings 60*d* (FIG. 1).

One embodiment of pallet P (See FIG. 1) is made of tubular structural members and generally rectangular in overall configuration. Pallet P includes tubular bottom section 60*f*, tubular top section 60*g* and resilient vibration isolators 60*h*. Isolators 60*h* are disposed between tubular bottom section 60*f* and tubular top section 60*g* at corners 60*i, j, k* and *l*. Isolators 60*h* are preferably a layer of hard rubber packing although other resilient materials may be used without departing from the spirit of the invention. Openings 60*e* disposed on tubular top section 60*g* are spaced to align with openings 60*d* on each wall section W when such wall sections W are assembled together. Accordingly, pallet P not only serves to further retain wall sections W together, but isolates container C from vibrations which routinely occur in normal truck, train and airplane travel. It has been observed that pallet P effectively reduces the shock which would normally have been transmitted to container C when the container was dropped. Pallet P may be attached to pallet mounting angles 60*a* via suitable, conventional quick release type fasteners (not shown) for ready assembly and disassembly. Finally, gap 60*m* between tubular top section 60*g* and tubular bottom section 60*f* is adapted for use by a forklift truck for easy handling of the assembled shipping container C. It is intended that the shipping container C be transported standing on end, supported and attached to pallet P.

In the preferred embodiment (FIG. 8) pallet P is made of tubular structural members and is generally rectangular in overall configuration. Pallet P is divided into two halves 60*n* and 60*p*, each half being attached to pallet mounting angle 60*a* on each wall section W. Each half 60*n* and 60*p* is resiliently mounted to mounting surface 60*q* of pallet mounting angle 60*a* through the use of shock absorbing material 60*r*. Suitable mounting brackets 60*s* are connected to each end of half 60*n*. Similarly, mounting brackets 60*t* are connected to half 60*p* adjacent each of its ends. Shock absorbing materials 60*r* may be attached to mounting surface 60*q* of pallet mounting angle 60*a* and mounting brackets 60*s* or 60*t* by using a suitable bonding adhesive (not shown) or a mechanical fitting (not shown). As seen in FIG. 8, half 60*p* has a reduced diameter section 60*u* disposed at each end. The outside diameter of reduced diameter section 60*u* is slightly smaller than the inside diameter of the tubular member comprising half 60*n*. As a result when two wall sections W are brought together, reduced diameter section 60*u* extends into half 60*n* thereby giving pallet P an overall rectangular configuration. It should be noted that to ease the insertion of reduced diameter section 60*u* into half 60*n* the ends 60*v* of half 60*n* may be outwardly flared. Accordingly, when two wall sections are locked together, halves 60*n* and 60*p* abut each other with reduced diameter section 60*u* extending into half 60*n*. Halves 60*n* and 60*p* each contain metal feet 60*w* which raise the container C off the ground and allow easy handling of the assembled container C by a forklift truck or a mobile dolly. As with the embodiment shown in FIG. 1, in the preferred embodiment of FIG. 8, the shock absorbing material 60*r* effectively reduces shock and high level vibration which routinely occurs in truck, train and airplane travel. It is intended that container C be transported standing on end supported and attached to pallet P. It is further understood that halves 60*n* and 60*p* may each be tubular members having square, rectangular or other shapes other than a round cross-section.

Referring to FIG. 2, shipping container C includes an adjustable, removable suspension system A flexibly mounted therein. The adjustable, removable suspension system A can be installed in each wall section W. Support system A includes a frame J, abutment means K (FIGS. 4 and 7), support strap means L, securing strap means M and locking means N (FIG. 6).

Figure 3:
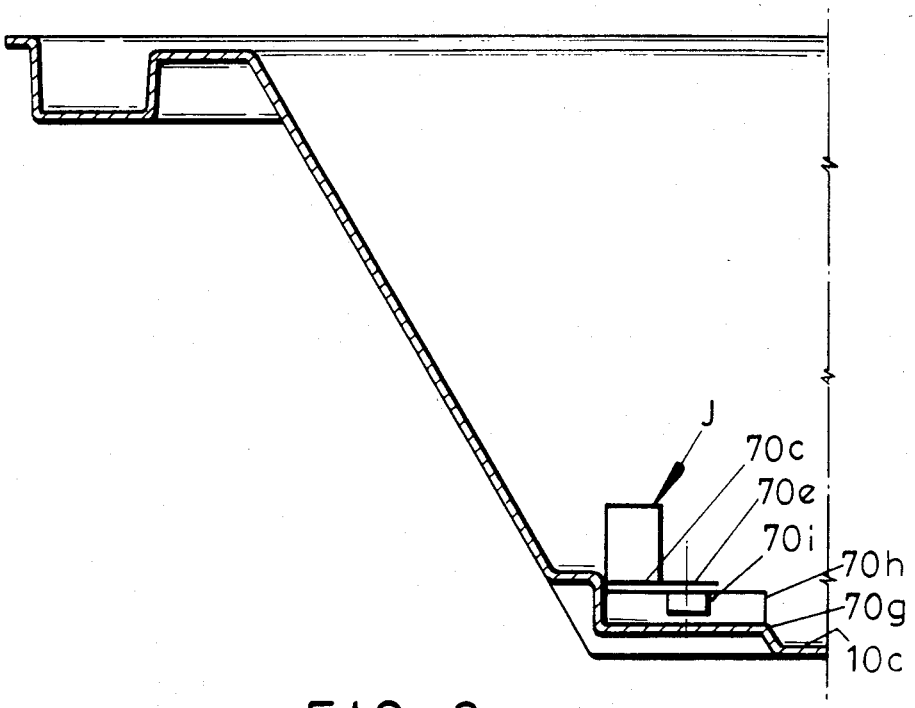
FIG. 3 is an enlarged detail of the sectional view shown in the dashed circle of FIG. 2.
Figures 4, 5, 7:
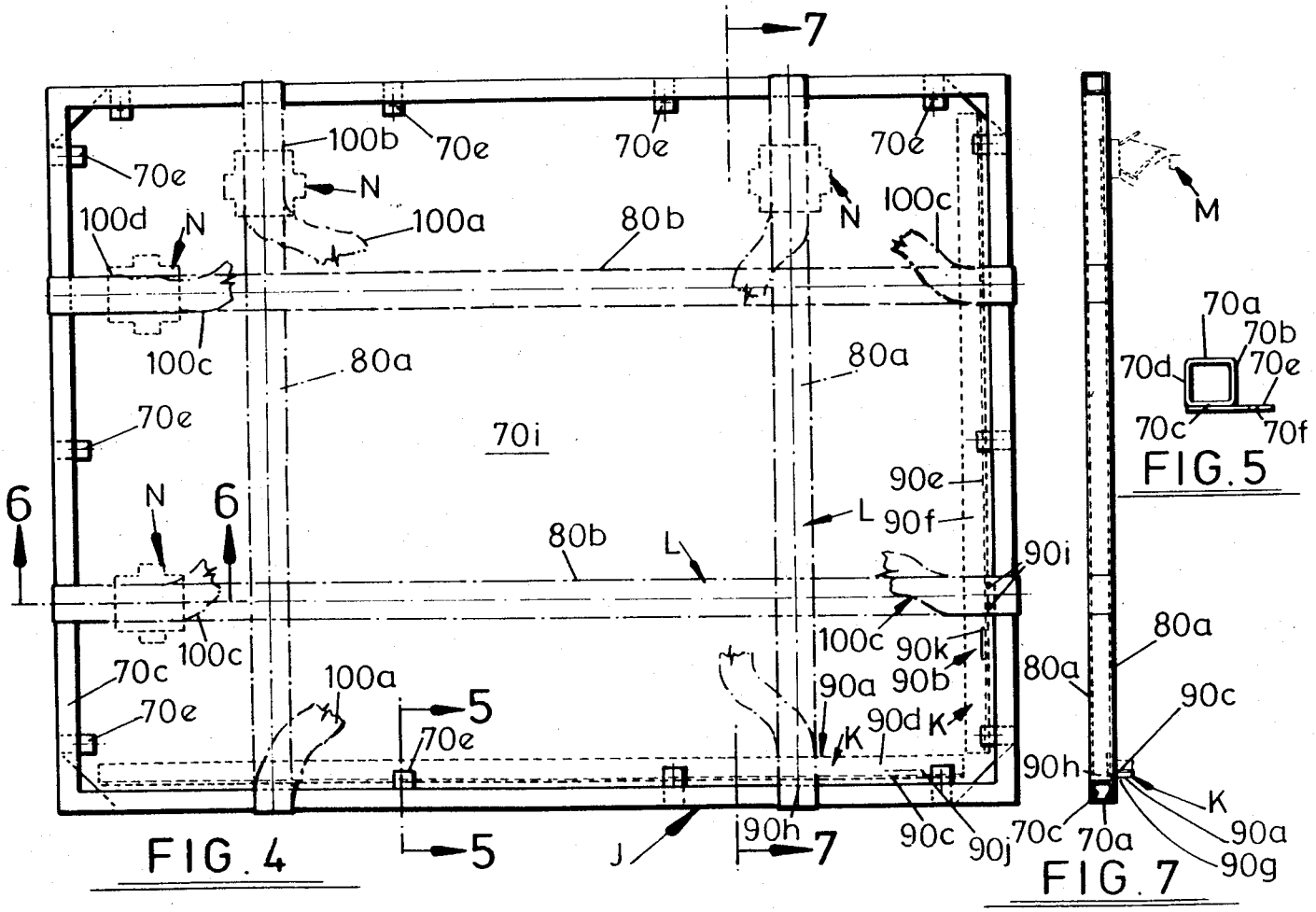
FIG. 4 is a plan view of the frame of the adjustable, removable suspension system.
FIG. 5 is a sectional elevation of the frame of the adjustable, removable suspension system taken along lines 5—5 of FIG. 4.
FIG. 7 is a sectional view taken along lines 7—7 of FIG. 4.
Figure 6:
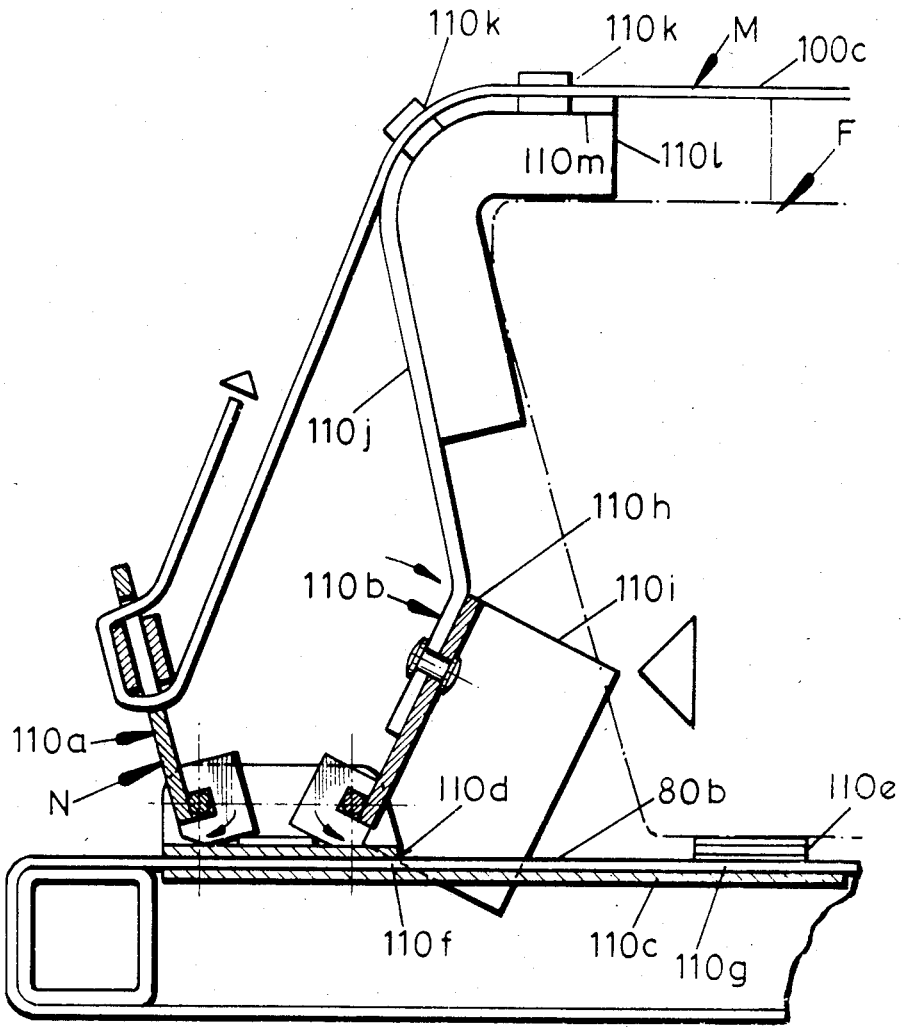
FIG. 6 is a sectional elevation of the preferred embodiment of the locking assembly as seen along lines 6—6 of FIG. 4.

As best seen in FIGS. 4 and 5, frame J has an essentially rectangular shape which conforms to the periphery of inner skin 10*c* of flat segment 10*a*. As shown in FIG. 5, frame J has a tubular cross-section of a square shape although rectangular and round shapes can be used without departing from the spirit of the invention. Accordingly, frame J is defined by surfaces 70*a*, 70*b*, 70*c* and 70*d*. The frame J is secured to wall section W via mounting tabs 70*e* which are connected to surface 70*c* at spaced relationships around frame J. Each mounting tab 70*e* defines a mounting opening 70*f*. As best shown in FIG. 3, inner skin 10*c* of flat segment 10*a* includes raised sections or mounting bosses 70*g*. Mounting bosses 70*g* coincide with the location of mounting tab 70*e* of frame J. A resilient packing layer 70*h* is attached to mounting boss 70*g*. Embedded within resilient packing layer 70*h* is a cylindrical threaded insert 70*i*. Frame J is secured to wall section W by any suitable, conventional mounting (not shown) such as a screw which is inserted through each opening 70*f* and threaded into each corresponding cylindrical insert 70*i*. Resilient packing layer 70*h* is preferably formed of hard rubber although other resilient materials may be used without departing from the spirit of the invention. Frame J is resiliently mounted to wall section W in that cylindrical insert 70*i* is free to move within resilient packing layer 70*h*.

An alternative method of mounting frame J to composite wall section W is illustrated in FIG. 1. As seen in FIG. 1, mounting bosses 70*g* are disposed around the periphery of flat segment 10*a*. A C-shaped resilient packing layer 70*h* is placed around surfaces 70*a*, 70*c* and 70*d* of frame J, adjacent the location of each mounting boss 70*g*. A retaining clip 70*k* is secured to mounting surface 70*m* which forms a part of mounting boss 70*g* and which is disposed in a plane parallel to surface 70*a* of frame J. Accordingly, when mounting clip 70*k* is secured to mounting surface 70*m* it also contacts resilient packing layer 70*h* thereby firmly retaining frame J to flat segment 10*a* yet at the same time allowing frame J to be isolated from mechanical shocks imparted to flat segment 10*a* due to the operation of resilient packing layer 70*h*.

Figure 9:
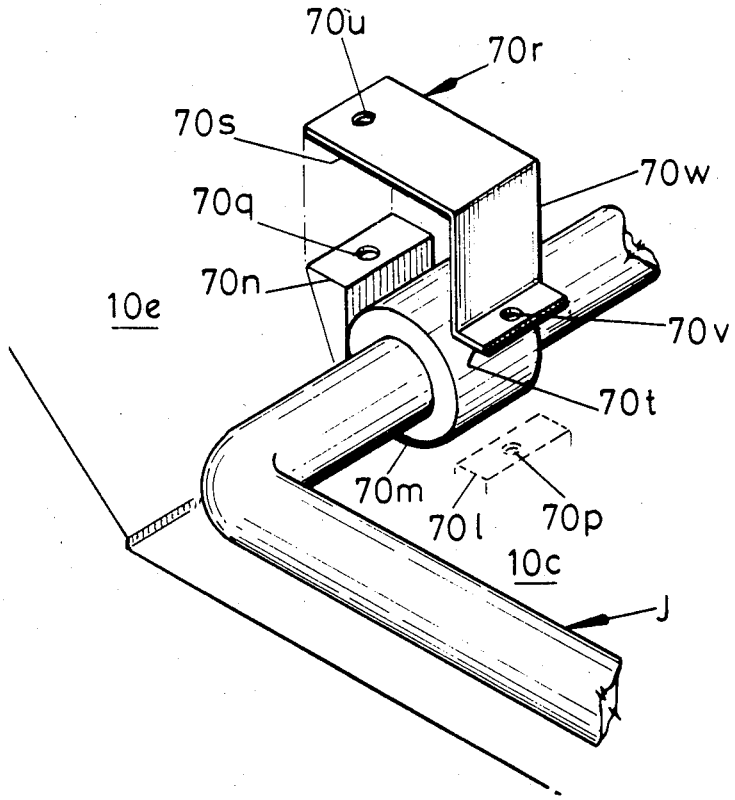
FIG. 9 is an exploded perspective view of the frame showing details of its mounting to the wall section.

The preferred method of mounting frame J to wall section W is shown in FIG. 9. As seen in FIG. 9, inner skin 10*c* has a plurality of mounting bosses 70*l* one of which is displayed in FIG. 9. A plurality of annular resilient rings 70*m* are disposed along frame J such that when frame J is lowered into a wall section W, annular resilient rings 70*m* are juxtaposed opposed adjacent to mounting bosses 70*l*. Mounting bosses 70*n* are disposed in innerskin 10*e* so that they are adjacent to annular resilient rings 70*m* on frame J when frame J is lowered into wall section W. Each mounting boss 70*l* contains a threaded insert 70*p*. Similarly, each mounting boss 70*n* contains a threaded insert 70*q*. Bracket 70*r* has two parallel segments 70*s* and 70*t*. Segment 70*s* has an opening 70*u* and segment 70*t* has an opening 70*v* disposed thereon. Bracket 70*r* is so designed such that when opening 70*u* is aligned with threaded insert 70*q*, opening 70*v* is aligned with threaded insert 70*p*. Similarly, when segment 70*t* comes in contact with mounting boss 70*l*, segment 70*s* simultaneously comes in contact with mounting boss 70n. The outside diameter of annular resilient rings 70m is such that when segment 70s is in contact with mounting boss 70n segment 70s is also in contact with annular rings 70m. At the same time, segment 70w which is disposed between segment 70s and 70t on bracket 70r, is in contact with annular resilient ring 70m. Therefore, annular resilient ring 70m is confined on four sides by inner skin 10c, mounting boss 70n segment 70s of bracket 70r and segment 70w of bracket 70r.

As best seen in FIGS. 4 and 7, support strap L includes straps 80a and 80b. Straps 80a span frame J and contact surfaces 70a, 70c and 70d of frame J. Straps 80a are preferably approximately fifty millimeters wide and made of black woven nylon, although other materials and widths can be used without departing from the spirit of the invention. Straps 80a are continuous loops and, as seen in FIG. 7, are disposed in a plane parallel to surfaces 70a and 70c. Straps 80b span the opening 70j defined by frame J in a direction perpendicular to straps 80a. Straps 80b are continuous and made of the same material and are the same width as straps 80a although other materials and widths may be used without departing from the spirit of the invention. Straps 80b also contact surfaces 70a, 70c and 70d of frame J. As shown in FIG. 4 straps 80a and 80b contact frame J at points removed from where mounting tabs 70e are connected to surface 70c on frame J. Straps 80a and 80b form a web in opening 70j defined by frame J for supporting a framed work of art.

Abutment K consists of a pair of elongated members 90a and 90b which have an L-shaped cross-section as shown in FIG. 7. Elongated member 90a has an abutting surface 90c and an mounting surface 90d. Similarly, elongated member 90b has an abutting surface 90e and a mounting surface 90f. As best seen in FIG. 7, abutting surface 90c defines a plurality of mounting slits 90g which are disposed at spaced intervals in alignment with straps 80a. Straps 80a extend through mounting slits 90g thereby preventing lateral movement of elongated member 90a toward elongated member 90b. As seen in FIG. 4, a pair of fasteners 90h are disposed in each strap 80a between frame J and elongated member 90a thereby acting as a travel stop and preventing elongated member 90a from moving in a direction perpendicular to its longitudinal axis into contact with frame J. Similarly, a pair of fasteners 90i are disposed in straps 80b between frame J and elongated member 90b thereby acting as a travel stop to elongated member 90b and preventing it from contacting frame J by moving in a direction perpendicular to its longitudinal axis. As shown in FIGS. 4 and 7, surfaces 90c and 90e of elongated members 90a and 90b, respectively, are substantially lined with a cushion 90j. Cushion 90j is preferably made of semi-rigid rubber although other suitable resilient materials may also be used.

As seen in FIG. 7, abutting surface 90c with cushioning means 90j attached thereto extends perpendicularly above straps 80a. Similarly, cushion 90k covers the abutting surface 90e of elongated member 90b which extends perpendicularly above straps 80b. Therefore, when a framed work of art is set on straps 80a and 80b, cushions 90j and 90k contact the frame of the work of art. As shown in FIG. 4, elongated members 90a and 90b are disposed in a spaced relation to each other along adjacent sides of frame J and their longitudinal axes form a substantially right angle.

It should be noted that when wall sections W are not in use, the elongated members 90a and 90b can pivot 90° so that abutting surfaces 90c and 90e lie against straps 80a and 80b, thus providing a flat surface which enables the wall sections W to be stacked one inside the other without damaging elongated members 90a and 90b.

The framed work of art in place on support strap L and in contact with abutment K, is secured to frame J via securing web M and locks N. Securing web M includes a plurality of straps 100a which are mounted to frame J over straps 80a adjacent surface 70a. Straps 100a each have a free end 100b which can be extended over a framed work of art resting on support strap L and secured to lock N which is slidably mounted to the corresponding strap 80a. Straps 100a may be sewn to straps 80a adjacent surface 70a. Alternatively, suitable conventional fasteners 90h may be employed to secure one end of straps 100a. Straps 100a are preferably made of approximately fifty millimeter wide black woven nylon although other materials and widths may be used without departing from the spirit of the invention.

Web M also includes straps 100c. Straps 100c have a free end 100d. Accordingly, straps 100c can be extended over a framed work of art and into engagement with a corresponding lock N slidably mounted to the corresponding strap 80b. Straps 100c may each be sewn to straps 80b adjacent surface 70a of frame J. In the alternative, suitable conventional fasteners 90i can be used to secure straps 100c to the corresponding strap 80b.

As can readily be seen in FIG. 4, each strap 80a has a corresponding strap 100a and each strap 80b has a corresponding strap 100c. Straps 100a and 100c when passed over a framed work of art and engaged in corresponding lock N provide substantial horizontal and vertical support for the framed work of art.

As shown in FIGS. 4 and 6, locks N are slidably mounted to each strap 80a and 80b, adjacent the opposite end of frame J and from where elongated members 90a and 90b are disposed.

As seen in FIG. 6, the preferred embodiment of each lock N includes a pivotally mounted locking assembly 110a and a clamp assembly 110b. Clamp assembly 110b includes a bottom flat plate member 110c and first plate member 110d and second plate member 110e. The juncture of bottom flat plate member 110c and first top plate member 110d defines slot 110f. The juncture of bottom flat plate member 110c with second top plate member 110e defines slot 110g. Slot 110f is aligned in the same plane with slot 110g thereby allowing strap 80a or strap 80b to pass therethrough depending on the location of clamp assembly 110b. As seen in FIG. 6, first top plate member 110b is disposed in a spaced relationship to second top plate member 100e along bottom flat plate member 110c.

A pivotally mounted cushion plate 110h is connected to first top plate member 110d. Two resilient cushions 110i are secured to the outer edge of the mounted cushion plate 110h. Mounted resilient cushion 110i may be a semi-rigid rubber, although other suitable resilient materials may also be used. The two mounted resilient cushions 110i are positioned on the clamp assembly 110b so that the cushions lie outside the width dimension of the supporting straps 80a and 80b. This allows cushion plate 110h to lie flat when wall sections W are not in use thus preventing damage to the lock N when wall sections W are stacked one inside the other. Resilient cushion 110i is mounted to pivotally mounted cushion plate 110h so that it faces cushion 90j or 90k depending upon whether clamp assembly 110b is slidably mounted to straps 80a or 80b respectively. As seen from FIGS. 4 and 6, a framed work of art abuts cushions 90j and 90k on two sides and resilient cushion 110i on the two opposite sides.

A removable flexible elongated bracket 110j is connected at one end to pivotally mounted cushion plate 110h. At its free end, flexible elongated bracket 110j is formed having a plurality of securing slots 110k. A second resilient cushion 110L is mounted adjacent the free end of flexible elongated bracket 110j to inside surface 110m. Web M, or strap 100c as shown in FIG. 6, is passed through slots 110f and 110g to pivotally mounted locking assembly 110a. Locking assembly 110a is a clasp lock mechanism of a type well known in the art. Locking assembly 110a serves two functions in that when it is in a perpendicular position to supporting straps 80a or 80b, it secures lock N to said straps. Locking assembly 110a also provides a clasp lock mechanism for straps 100a and 100b. As shown in FIG. 6, when locking assembly 110a is moved into a vertical position relative to strap 80a or 80b, it forces first plate member 110d toward blottom flat plate member 110c thereby fixing the position of lock N on strap 80a or 80b. When wall section W is not in use, locking assembly 110a is designed to lie flat against supporting straps 80a or 80b thus allowing wall sections W to be stacked without damaging locking assembly 110a. It is desirable that when removably mounted resilient cushion 110i and second resilient cushion 110L contact the frame of the work of art F (FIG. 6) that the angle between first top plate member 110d and pivotally mounted cushion plate 110h remain acute.

Figure 10:
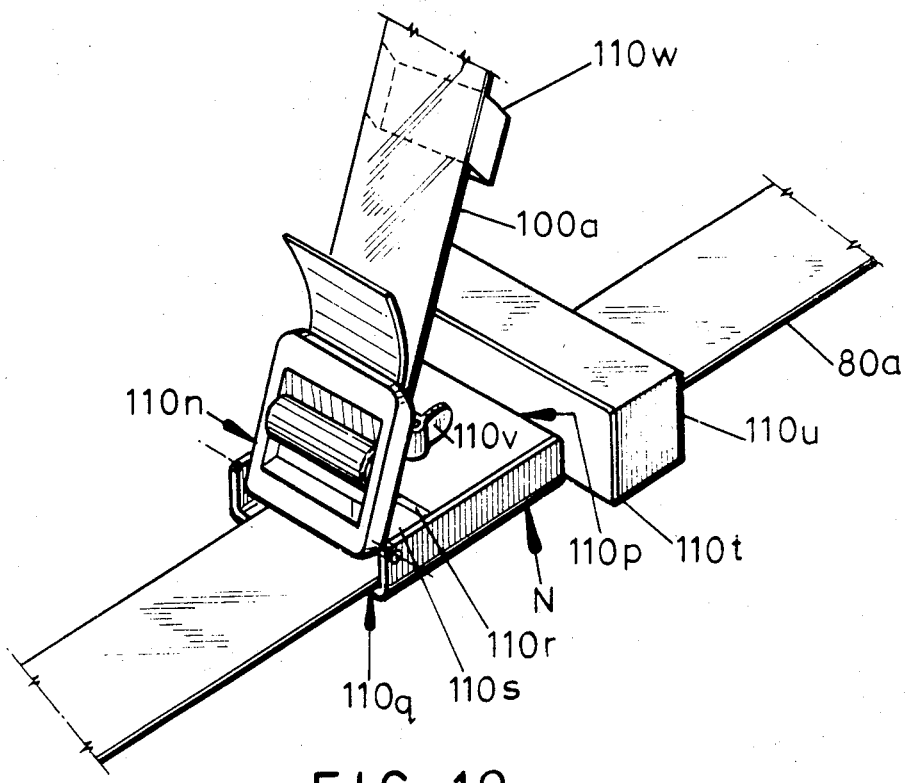
FIG. 10 is a perspective view of an alternate embodiment of the lock assembly.

As seen in FIG. 10, an alternative embodiment of lock N, includes a pivotally mounted locking assembly 110n and a clamp assembly 110p. Clamp assembly 110p includes a bottom flat plate member 110q and a movably mounted top plate 110r. A slot 110s is defined between bottom flat plate member 110q and movably mounted top plate 110r. Clamp plate 110t is disposed in a plane substantially perpendicular to the plane wherein movably mounted top plate 110r and bottom flat plate member 110q are disposed. Pivotally mounted locking assembly 110n is disposed adjacent the opposite end of bottom flat plate member 110q and movably mounted top plate 110r, from clamp plate 110t. A cushion member 110u is attached to clamp plate 110t by a suitable contact adhesive or other mechanical means. Lock N may be suitably disposed on supporting straps 80a and 80b for securing a work of art thereto. Accordingly, straps 80a or 80b extend through slot 110s in order to secure a lock N thereon. Lock N is designed to be moved along strap 80a (FIG. 10) until cushion 110u contacts the work of art (not shown). Locks N are moved along straps 80a and 80b until cushion members 110u secure two adjacent sides of a work of art and force the work of art against cushions 90j and 90k on elongated members 90a and 90b. In order to secure lock N in a fixed position on a strap 80a or 80b, nut 110v is rotated thereby decreasing the height of slot 110s and securing lock N to the strap 80a or 80b. With cushion members 110u adjacent straps 80a and 80b, against the work of art, the work of art is effectively held on straps 80a and 80b with cushion members 110u holding two sides of the work of art and cushions 90j and 90k on elongated members 90a and 90b holding the two opposing sides of the work of art. To further secure the work of art to frame J, straps 100a or 100c can be passed over the work of art and through pivotally mounting locking assembly 110n thereby securing the work of art between straps 80a and 80b on one side and straps 100a and 100c on the other side. A slidably mounted cushion 110w is secured to either strap 100a or 100c for contact with the work of art thereby preventing direct contact between the work of art and straps 100a and 100c.

In use, a framed work of art F is placed face up on straps 80a and 80b. The framed work of art is moved on top of straps 80a and 80b until two of its adjoining sides come in contact with cushions 90j and 90k on elongated members 90a and 90b, respectively. Thereafter, straps 100a are passed over the framed work of art F and through slots 110k on the locks N slidably mounted to each strap 80a. Straps 100c are also passed over the framed work of art through slots 110k of locks N slidably mounted to each strap 80b. Finally, straps 100a and 100c are secured in pivotally mounted locking assembly 110a thereby insuring that removably mounted resilient cushion 110i and second resilient cushion 110L are firmly in contact with the framed work of art F. Once the framed work of art is secured in the adjustable, removable suspension system A, wall sections W are brought together and secured via lugs 40a and through bolts 40c. Finally, pallet P is secured to the respective pallet mounting angle 60a on each wall section W. The framed work of art F is then ready to be shipped.

The foregoing disclosure and description of the invention are illustrative and explanatory thereof, and various changes in the size, shape and materials, as well as in the details of the illustrated construction may be made without departing from the spirit of the invention.

We claim:

1. A shipping container for transporting works of art comprising:

a pair of composite wall sections each further comprising:

a substantially flat segment;

a plurality of side sections adjoining said flat segment thereby defining an enclosure;

said flat and side segments having an inner and outer skin and an insulation means disposed between said inner and outer skin for protection of the work of art from external environmental conditions by maintaining a relatively constant humidity between said composite wall sections, said side segments having a first flange formed about their periphery to provide a seal between said wall sections when said container is closed;

retaining means for securing one composite wall section to another;

sealing means disposed between said first flange of each of said composite wall sections for sealing therebetween thereby preventing fluids from entering the container;

pallet means mounted to the exterior of said composite wall sections for supporting and cushioning said composite wall sections from shocks during transit; and wherein each of said composite wall sections further comprise a pallet mounting bracket for mounting said pallet means to each of said composite wall sections when said first flanges on said wall sections are aligned and abutting.

2. The shipping container of claim 1 wherein said pallet means further comprises:

a rigid elongated top section adapted to be mounted to said pallet mounting brackets of said composite wall sections;

a rigid elongated bottom section; and resilient shock and vibration cushioning means for connecting said elongated top and bottom sections of said pallet in a spaced relation to each other, to reduce shocks and vibration transmitted to the container during shipment and to facilitate handling of the container by machine.

3. The shipping container of claim 1 wherein said pallet means further comprises:

an elongated first section resiliently mounted to said bracket on one of said composite wall sections and having a projection extending longitudinally at each end thereof; and a second elongated section resiliently mounted to said bracket on the other said composite wall section and having an opening in each end;

whereupon when said composite wall sections are assembled together said projections of said first section extend into said openings in said ends of said second section to form a supporting structure to cushion said composite wall sections from shocks.

4. The shipping container of claim 3 further including:

a plurality of feet on said first and second sections thereby elevating said first and second sections from a support surface.

5. The shipping container of claim 1 further including:

an adjustable, removable suspension system for supporting works of art connected to each of said composite wall sections.

6. A shipping container for transporting works of art comprising:

a pair of composite wall sections each further comprising:

a substantially flat segment;

a plurality of side sections adjoining said flat segment thereby defining an enclosure;

said flat and side segments having an inner and outer skin and an insulation means disposed between said inner and outer skin for protection of the work of art from external environmental conditions, said side segments having a first flange formed about their periphery to provide a seal between said wall sections when said container is closed;

retaining means for securing one composite wall section to another; and sealing means disposed between said first flange of each of said composite wall sections for sealing therebetween thereby preventing fluids from entering the container;

an ajustable, removable suspension system for supporting works of art connected to each of said composite wall sections;

said ajustable, removable suspension system further comprises:

a support frame resiliently mounted to the periphery of an inner wall of said composite wall section and formed having a central opening therethrough;

support strap means secured to said frame and spanning said central opening for supporting a work of art;

abutment means mounted to said support strap means for positioning the work of art on said support strap means;

securing web means attached to said first strap means for securing a work of art against said support strap means and said abutment means; and locking means for adjustably connecting said support and securing strap means thereby allowing works of art of different dimensions to be secured therebetween and against said abutment means.

7. The shipping container of claim 6 wherein said supporting strap means of the adjustable, removable suspension system further comprises:

a first strap extending across said opening in said frame; and a second strap extending across said opening in said frame at substantially right angle to said first strap.

8. The shipping container of claim 7 wherein said abutment means further comprises:

a first elongated member having an L-shaped cross-section and wherein said first elongated member is formed having a first mounting surface disposed in a plane substantially parallel to said first strap; a first abutting surface extending substantially perpendicularly beyond the plane of the opening in said support frame, and a first mounting slit therethrough; and wherein said first strap extends through said first mounting slit to retain said first elongated member in a spaced relationship to said frame in a direction parallel the longitudinal axis of said first elongated member.

9. The shipping container of claim 8 wherein said abutment means further comprises:

a first travel stop means on said first strap between said first elongated member and said support frame for preventing movement of said first elongated member into contact with said support frame.

10. The shipping container of claim 9 wherein said abutment means further comprises a second elongated member having an L-shaped cross-section and wherein said second elongated member is formed having a second mounting surface disposed in a plane substantially parallel to said second strap; a second abutting surface extending substantially perpendicularly beyond the plane of the opening in said support frame and having a second mounting slit therethrough;

whereby said second strap extends through said second mounting slit to retain said second elongated member in a spaced relationship to said support frame in a direction parallel to the longitudinal axis of said second elongated member.

11. The shipping container of claim 10 wherein said abutment means further comprises:

a second travel stop means on said second strap between said second elongated member and said support frame for preventing movement of said second elongated member into contact with said support frame.

12. The shipping container of claim 11 wherein said first and second elongated members are disposed parallel to and adjacent to two connected sides of said support frame with their longitudinal axes intersecting at a substantially right angle.

13. The shipping container of claim 8 wherein:

said first and second abutting surfaces each further comprise:

cushioning means for receiving the work of art and protecting the work of art from direct contact with said first and second abutting surfaces.

14. The shipping container of claim 13 wherein:

said first and second elongated members are pivotally mounted to said support strap means thereby allowing said first and second abutting surfaces to be aligned with said support strap means to allow nesting of one of said composite wall sections in another composite wall section without damaging said first and second elongated members.

15. The shipping container of claim 14 wherein said support frame is formed having a tubular cross-section and further comprising:

a plurality of resilient members at spaced intervals on said support frame; and retaining clips in contact with said resilient members on said support frame for resiliently mounting said support frame to said wall sections.

16. The shipping container of claim 7 wherein said securing web means further comprises:

a third strap secured at one end to said first strap adjacent said support frame; and a fourth strap secured at one end to said second strap adjacent said support frame; and wherein said third and fourth straps secure the work of art to said first and second straps and against said first and second elongated members.

17. The shipping container of claim 16 wherein said locking means further comprises:

a first clamp means for securing said third strap over the work of art, said first clamp means being slidably mounted to said first strap; and a second clamp means for securing said fourth strap over the work of art, said second clamp means being slidably mounted to said second strap.

18. The shipping container of claim 17 wherein said first and second clamp means each comprise:

a bottom plate member;

a first top plate member lying in a plane substantially parallel to said bottom plate and connected to said bottom plate member so as to define a first slot therebetween;

a second top plate member lying in a plane substantially parallel to said bottom plate and connected to said bottom plate member so as to define a second slot therebetween;

said second top plate member being in a spaced relation to said first top plate member and wherein said first slot is disposed in the same plane as said second slot;

whereby said support strap means is threaded through said first and second slots to slidably mount said first and second means to said support strap means.

19. The shipping container of claim 18 wherein said first and second clamp means each further comprise:

a pivotally mounted cushion plate connected to the end of said first top plate member adjacent said second top plate member;

a first resilient cushion connected to said pivotally mounted cushion plate;

a flexible elongated bracket connected at one end to said pivotally mounted cushion plate and formed having a plurality of securing slots adjacent its opposite free end; and a second resilient cushion connected adjacent the free end of said flexible elongated bracket.

20. The shipping container of claim 19 wherein said locking means further comprises:

a pivotally mounted locking assembly connected to the end of said first top plate member opposite said pivotally mounted cushion plate, and wherein said securing web means is adapted to pass over the work of art positioned on said support strap means, through said securing slots of said flexible elongated bracket and to said pivotally mounted locking assembly thereby forcing said first resilient cushion and said second resilient cushion into contact with the work of art to secure the work of art in the opening defined by said support frame.

21. The shipping container of claim 14 wherein:

the angle formed by said pivotally mounted cushion plate and said first top plate member remains acute after said first resilient member is secured against the work of art.

22. The shipping container of claim 17 wherein said first and second clamps each comprise:

a bottom plate member;

a top plate movably mounted to said bottom plate member defining a slot therebetween, said support strap means extending through said slot;

tightening means whith said top plate for moving said top plate toward said bottom plate for secruing said first and second clamps to said support strap means.

23. The shipping container of claim 22 further including:

a cushion plate mounted to one end of said bottom plate member;

a first resilient cushion mounted to said cushion plate said cushion selectively movable into contact with a work of art adjacent to said support strap means; and a pivotally mounted locking assembly connected to said bottom plate member at the opposite end of said bottom plate member from said cushion plate;

a slidably mounted second resilient cushion mounted to said securing web means;

whereupon said securing web means is adapted to pass over the work of art positioned on said support strap means, with said second resilient cushion in contact with the work of art, and through said locking assembly to secure the work of art in the opening defined by said support frame.

24. The shipping container of claim 15 wherein said securing web means further comprises:

a third strap secured at one end to said first strap adjacent said support frame; and a fourth strap secured at one end to said second strap adjacent said support frame; and wherein said third and fourth straps secure the work of art to said first and second straps and against said first and second elongated members.

25. The shipping container of claim 24 wherein said locking means further comprises:

a first clamp means for securing said third strap over the work of art, said first clamp means being slidably mounted to said first strap; and a second clamp means for securing said fourth strap over the work of art, said second clamp means being slidably mounted to said second strap.

26. The shipping container of claim 25 wherein said first and second clamp means each comprise:

a bottom plate member;

a first top plate member lying in a plane substantially parallel to said bottom plate and connected to said bottom plate member so as to define a first slot therebetween;

a second top plate member lying in a plane substantially parallel to said bottom plate and connected to said bottom plate member so as to define a second slot therebetween;

said second top plate member being in a spaced relation to said first top plate member and wherein said first slot is disposed in the same plane as said second slot;

whereby said support strap means is threaded through said first and second slots to slidably mount said first and second means to said support strap means.

27. The shipping container of claim 26 wherein said first and second clamp means each further comprise:

a pivotally mounted cushion plate connected to the end of said first top plate member adjacent said second top plate member;

a first resilient cushion connected to said pivotally mounted cushion plate;

a flexible elongated bracket connected at one end to said pivotally mounted cushion plate and formed having a plurality of securing slots adjacent its opposite free end; and a second resilient cushion connected adjacent the free end of said flexible elongated bracket.

28. The shipping container of claim 27 wherein said locking means further comprises:

a pivotally mounted locking assembly connected to the end of said first top plate member opposite said pivotally mounted cushion plate, and wherein said securing web means is adapted to pass over the work of art positioned on said support strap means, through said securing slots of said flexible elongated bracket and to said pivotally mounted locking assembly thereby forcing said first resilient cushion and said second resilient cushion into contact with the work of art to secure the work of art in the opening defined by said support frame.

29. The shipping container of claim 28 where:

the angle formed by said pivotally mounted cushion plate and said first top plate member remains acute after said first resilient member is secured against the work of art.

30. The shipping container of claim 29 wherein said first and second clamps each comprise:

a bottom plate member;

a top plate movably mounted to said bottom plate member defining a slot therebetween, said support strap means extending through said slot;

tightening means with said top plate for moving said top plate toward said bottom plate for securing said first and second clamps to said support strap means.

31. The shipping container of claim 30 further including:

a cushion plate mounted to one end of said bottom plate member;

a first resilient cushion mounted to said cushion plate said cushion selectively movable into contact with a work of art adjacent to said support strap means; and a pivotally mounted locking assembly connected to said bottom plate member at the opposite end of said bottom plate member from said cushion plate;

a slidably mounted second resilient cushion mounted to said securing web means;

whereupon said securing web means is adapted to pass over the work of art positioned on said support strap means, with said second resilient cushion in contact with the work of art, and through said locking assembly to secure the work of art in the opening defined by said support frame.

32. A shipping container for transporting works of art comprising:

a pair of composite wall sections each further comprising:

a substantially flat segment;

a plurality of side sections adjoining said flat segment thereby defining an enclosure;

said flat and side segments having an inner and outer skin and an insulation means disposed between said inner and outer skin for protection of the work of art from external environmental conditions by maintaining a relatively constant humidity between said composite wall sections, said side segments having a first flange formed about their periphery to provide a seal between said wall sections when said container is closed;

retaining means for securing one composite wall section to another; and sealing means disposed between said first flange of each of said composite wall sections for sealing therebetween thereby preventing fluids from entering the container;

an adjustable, removable suspension system for supporting works of art connected to each of said composite wall sections.

* * * * *

UNITED STATES PATENT AND TRADEMARK OFFICE

CERTIFICATE OF CORRECTION

PATENT NO. : 4,664,254

DATED : May 12, 1987

INVENTOR(S) : CHRISTINE L. SITWELL, KEITH WRIGHTSON and RICHARD C. SPARKS

It is certified that error appears in the above-identified patent and that said Letters Patent is hereby corrected as shown below:

ON THE TITLE PAGE,

Please add the following:

ASSIGNEE: Christine Leback Sitwell

Signed and Sealed this

Eighteenth Day of August, 1987

*Attest:*

*Attesting Officer*

DONALD J. QUIGG

*Commissioner of Patents and Trademarks*